United States Patent [19]

Babai et al.

[11] 3,975,934

[45] Aug. 24, 1976

[54] KEY-OPERATED DOOR LOCKING DEVICE

[76] Inventors: David Babai, 23 Ein Hakoreh St., Rishon Lezion; Joseph Shabtai, 41 Guilim St., Holon, both of Israel

[22] Filed: Mar. 20, 1975

[21] Appl. No.: 560,115

[52] U.S. Cl. ..... 70/120; 70/82

[51] Int. Cl.[2] ..... E05B 63/14; E05B 65/44

[58] Field of Search ..... 70/82, 116, 120, 123

[56] References Cited

UNITED STATES PATENTS

| | | | |
|---|---|---|---|
| 1,046,438 | 12/1912 | Caldwell | 70/120 X |
| 1,607,038 | 11/1926 | Baron | 70/120 X |
| 2,969,666 | 1/1961 | Muessel | 70/116 |
| 3,545,799 | 12/1970 | Gertsfeld | 70/120 X |

*Primary Examiner*—Robert Wolfe
*Assistant Examiner*—A. Craig
*Attorney, Agent, or Firm*—Benjamin J. Barish

[57] ABSTRACT

A key-operated door locking device includes a conventional rim lock adapted to be mounted to one side of the door and having a bolt projectable and withdrawable with respect to the door frame by means of a dog carried on the lock cylinder and rotatable by the insertion and rotation of the proper key. The locking device further includes a coupling between the cylinder dog and a rotatable member eccentrically mounting three pivotable rods extending completely across the door so as to be projectable and withdrawable from the three remaining sides of the door, the coupling being effective, upon the rotation of the cylinder dog by the proper key, not only to cause the bolt to be projected into or withdrawn from its respective recess, but also to cause the rotatable member to be rotated and thereby to project or withdraw the rods with respect to their respective recesses.

10 Claims, 5 Drawing Figures

FIG. 2
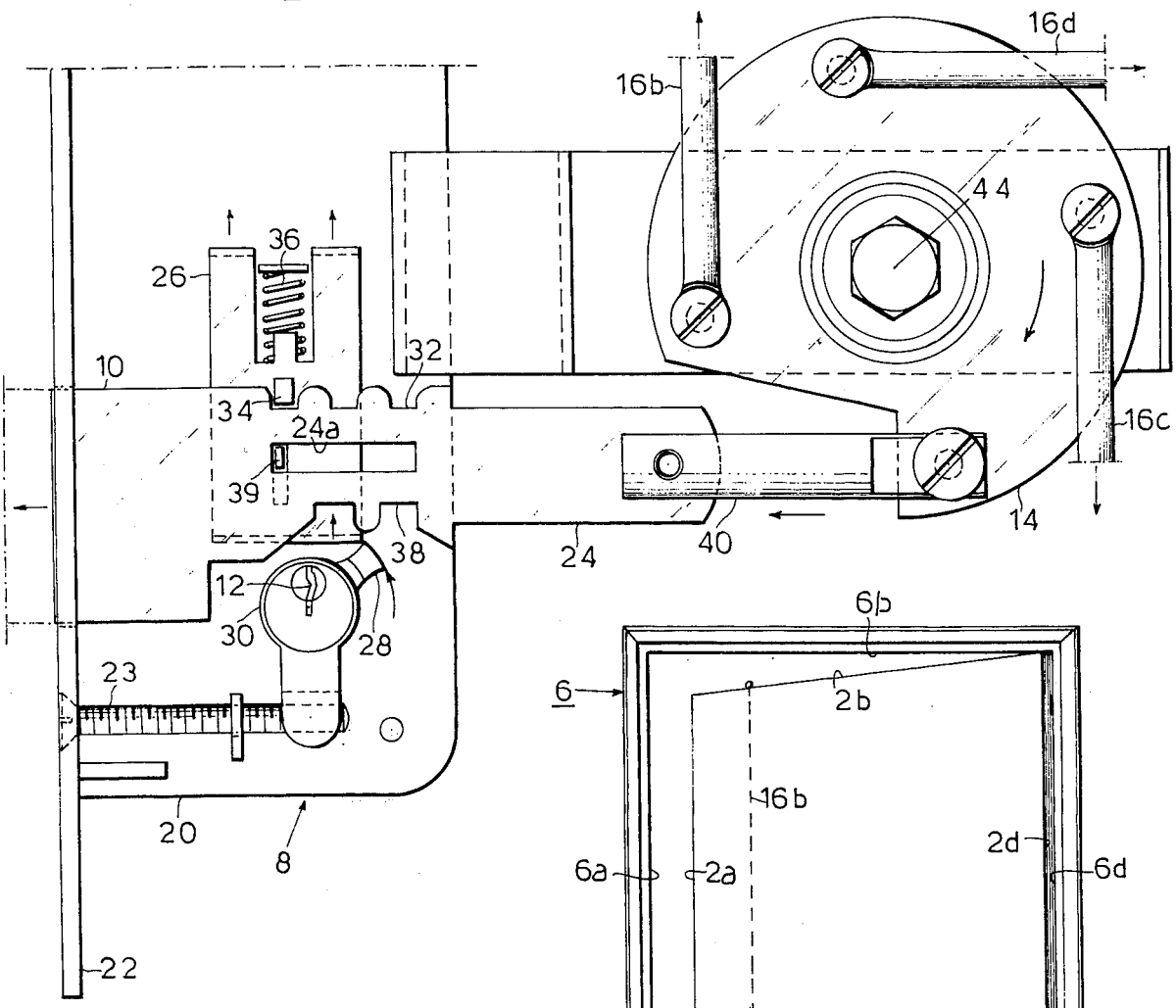
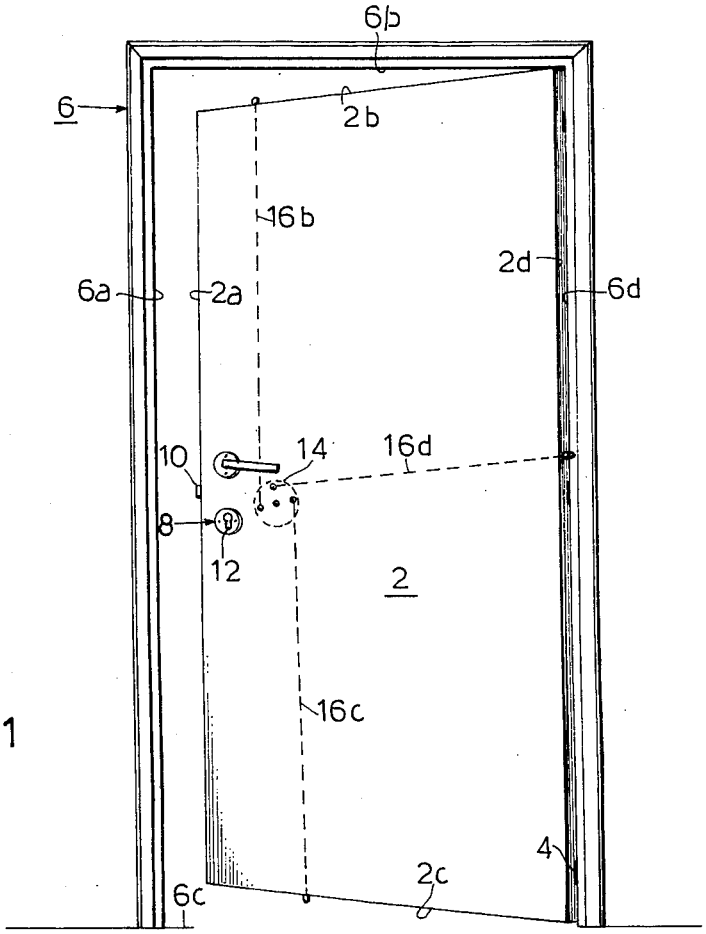
FIG. 1

FIG.3
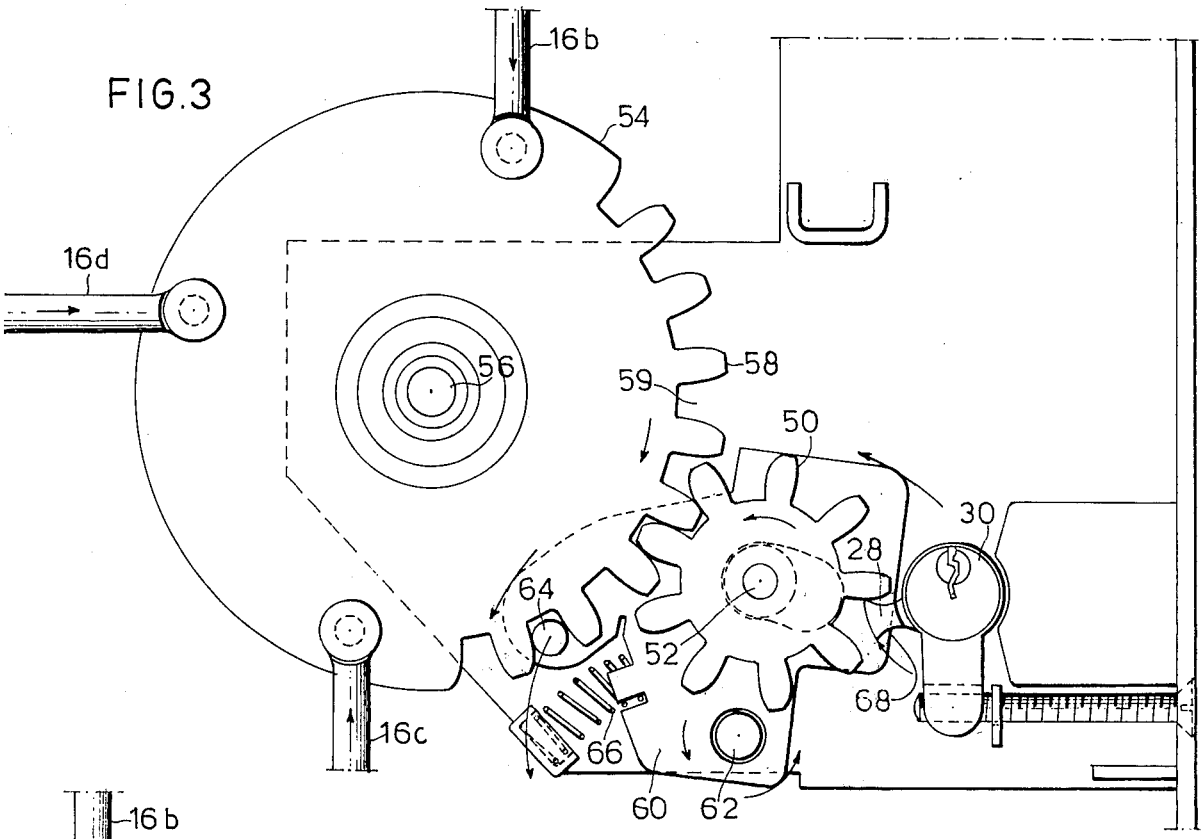
FIG.4
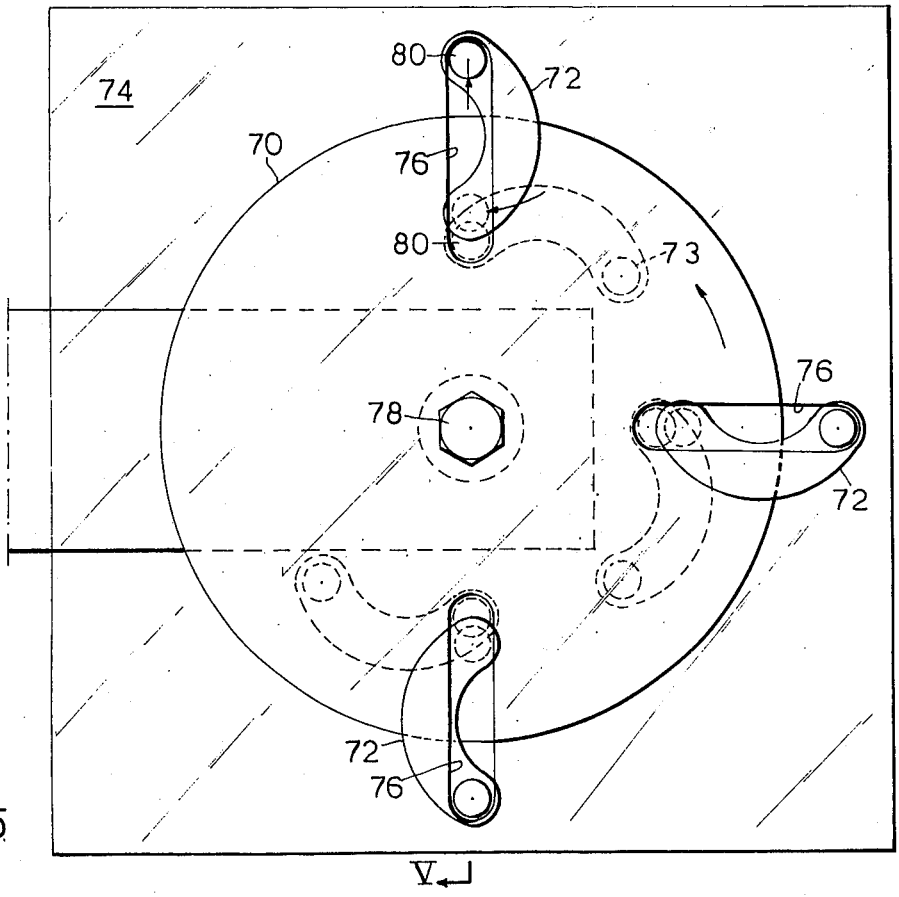
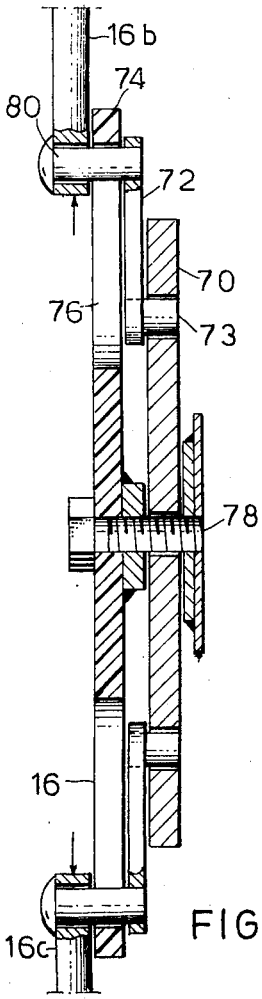
FIG.5

KEY-OPERATED DOOR LOCKING DEVICE

BACKGROUND OF THE INVENTION

The present invention relates to locking devices, and particularly to key-operated door locking devices for preventing forced entry by unauthorized persons into enclosed spaces, such as buildings, rooms, cabinets, safes, and the like.

The invention is particularly useful with the conventional rim locks of the type which includes a cylinder within the lock casing and rotatable upon the insertion of the proper key into the keyhole, and a dog carried by the cylinder engageable with a bolt for projecting and withdrawing the bolt into and out of a recess in the door frame. One of the drawbacks of such conventional rim locks, is that they are usually not particularly difficult to open by the insertion of an instrument between the locking bolt and the door frame to force the bolt back into the lock casing.

A number of door locking devices have been devised which include rods projectable from a plurality of sides of the door into recesses formed in the door frame. One such locking device includes a handle which is released for rotation by the insertion of the proper key, the handle causing the rods to be projected and withdrawn. Such a locking device, however, is of costly construction and is used primarily in expensive safes and the like.

Another such locking device includes an arrangement wherein the rods are pivotably mounted to a rotatable member located in the center of the door; the rotatable member is rotated by teeth formed on the lock cylinder which cylinder is rotated by the insertion of the proper key in the keyhole.

Such a device, however, requires two keys to be used, one for the normal rim lock mounted adjacent to one side of the door, and the other for the special centrally-mounted locking device which actuates the rods.

SUMMARY OF THE INVENTION

An object of the present invention is to provide a novel key-operated door locking device having advantages in the above respects.

The invention is particularly useful with a conventional locking device which includes a lock casing mountable adjacent to one side of a door and having a keyhole for the insertion of a key; a cylinder within the casing and rotatable by the proper key when inserted into the keyhole and rotated therein; a dog carried by the cylinder and rotatable therewith; and a bolt engageable by the dog and adapted to be projected and withdrawn with respect to the casing into and out of a recess in the door frame at said one side of the door.

According to the invention, the locking device further includes a rotatable member rotatably mounted on an axis substantially parallel to the axis of the keyhole; at least two rods each pivotably mounted at one end to a different eccentric point on the rotatable member and extending to the upper and lower edges of the door so as to be projected into further recesses in the door frame upon the rotation of the rotatable member in one direction, and to be withdrawn therefrom upon the rotation of the rotatable member in the opposite direction; and a coupling between the cylinder dog and the rotatable member effective, upon the rotation of the dog by the proper key to cause the bolt to be projected into or withdrawn from its respective recess, also to cause the rotatable member to rotate and to project or withdraw the rods from their respective recesses.

In one described embodiment the coupling includes a push-pull rod connected between the tail of the bolt and said rotatable member.

In a second described embodiment the coupling includes a toothed wheel rotatably mounted on an axis parallel to the rotatable member and keyhole axes and rotatable by the dog for rotating the rotatable member.

According to another important feature, each rod may be pivotably mounted at one end to the rotatable member by means of a link pivotable at one end to the rotatable member and connected at the other end to the respective rod.

The locking device may further include a plate formed with a pair of slots aligned with each other and with the axis of rotation of the rotatable member, the rods each including a guide element received in one of the slots and guiding the movement of its rod such that in the projected position of the rod, it is aligned with the pivotable end of its respective link and with the axis of rotation of the rotatable member.

The invention provides a number of important advantages over the previously known key-operated door locking devices briefly discussed above. A first important advantage is that it enables the conventional rim lock to be used, by merely adding to it the plurality of rods and the mechanism for projecting and withdrawing them by the cylinder dog when the dog is rotated by the proper key. Thus, standard conveniently available parts may be used, thereby decreasing the cost of installing such a locking device. Moreover, the same key which is used for the conventional lock is also used to actuate the rods, thereby relieving the authorized user of carrying two keys and of making two manipulations in order to open the door.

Further features and advantages of the invention will be apparent from the description below.

BRIEF DESCRIPTION OF THE DRAWINGS

The invention is herein described, by way of example only, with reference to several preferred embodiments illustrated in the accompanying drawings, wherein:

FIG. 1 is a side elevational view illustrating a door equipped with the novel key-operated door locking device of the present invention;

FIG. 2 is a side elevational view of one mechanism that may be used in the locking device of FIG. 1;

FIG. 3 is a corresponding side elevational view of another mechanism that may be used in the locking device;

FIG. 4 is a side elevational view illustrating a further protective feature which may be used in the mechanism of either FIGS. 2 or 3; and FIG. 5 is an end elevational view of the mechanism of FIG. 4.

DESCRIPTION OF THE PREFERRED EMBODIMENTS

FIG. 1 illustrates a door, generally designated 2, pivotably mounted by hinges 4 to one side of a door frame 6. The door includes a conventional rim lock, generally designated 8, mounted adjacent edge 2*a* of the door and having a bolt 10 projectable and withdrawable with respect to a recess formed in the corresponding side 6*a* of the door frame upon the insertion and rotation of the proper key with respect to the lock keyhole 12.

According to the present invention, the rim lock is provided with an arrangement including a rotatable member in the form of a disc 14 (shown in broken lines in FIG. 1 and more particularly in FIG. 2) which is rotatable by the dog carried by the lock cylinder for projecting a plurality of rods 16*b*, 16*c*, and 16*d* from the remaining three sides 2*b*, 2*c*, 2*d* of door 2 into recesses formed in sides 6*b*, 6*c*, 6*d* of the door frame. One form of mechanism that may be used for projecting and withdrawing rods 16*b*, 16*c* and 16*d* is more clearly illustrated in FIG. 2.

As shown in FIG. 2, the rim lock 8 includes a housing having a pair of side plates 20 (one side plate having been removed in FIG. 2 for purposes of illustrating the mechanism), and a face plate 22. The lock is mounted within a recess formed in the door 2 with the face plate 22 flush with and fastened to the door by screws 23. Bolt 10 is movable within a slot formed in face plate 22 so as to be projectable into and withdrawable from a recess formed in side 6a of the door frame.

Only the main elements of this known lock construction are illustrated in FIG. 2, these elements including, besides the above-mentioned ones, a tail 24 formed integrally with bolt 10, a tumbler 26 movable into and out of engagement with the bolt tail 24, and a dog 28 fixed to cylinder 30 which is rotated upon the insertion and the rotation of the proper key. The upper edge of bolt tail 24 is notched as shown as 32, which notches are cooperable with a catch 34 carried by tumbler 26, the tumbler being urged by a spring 36 to seat its catch 34 into one of the tail notches 32. The lower edge of the bolt tail 24 is also formed with notches 38, these notches being engageable by dog 28 of cylinder 30 upon the insertion and rotation of the proper key. When dog 28 is rotated by the key, it first engages the lower surface of tumbler 26 to raise the tumbler and thereby to cause its catch 34 to unseat from the respective notch 32. The dog then enters a notch 38 formed in the lower edge of the bolt tail 24 to project the bolt one step of movement for each rotation of the dog, the bolt movement being guided by slot 24*a* in bolt tail 24 and fixed guide pin 39. The example illustrated in FIG. 2 shows two notches formed on each of the two edges of the bolt tail 24, so that the bolt may be advanced two steps (by two key revolutions) to its fully projected position.

The bolt is withdrawn by rotating the key, and thereby dog 28, in the opposite direction, each rotation of the dog causing the bolt to withdraw one notch or step as in the projecting operation.

Since the foregoing elements are well known in rim lock constructions, further details are not deemed necessary.

According to the present invention, a push-pull rod 40 is attached at one end to bolt tail 24, and at the opposite end it is pivotably mounted to the previously mentioned disc 14 which projects and withdraws the rods 16*b*, 16*c*, and 16*d* at the same time bolt 10 is projected and withdrawn. Disc 14 is rotatably mounted about an axis of rotation 44 which is parallel to keyhole 12 and cylinder 30. Each of the rods 16*b*, 16*c*, 16*d* is pivotably mounted at its inner end to a different eccentric point on disc 14, and then passes for the remaining length or width of the door to the respective door edges 2*b*, 2*c*, 2*d*.

The device illustrated in FIGS. 1 and 2 operates as follows: In its released condition, bolt 10 of the rim lock 8 is withdrawn from its respective recess 6*a* in the door frame, the bolt being in the full-line positions shown in FIG. 2. In this condition, rods 16*b*, 16*c* and 16*d* are also in their withdrawn positions with respect to their respective recesses in the door-frame sides 6*b*, 6*c* and 6*d*.

In order to close the lock, the proper key is inserted into keyhole 12 and is rotated in the counter-clockwise direction as viewed in FIG. 2. Dog 28 first engages tumbler 26 and raises the tumbler against spring 36 to cause its catch 34 to unseat from the left upper notch 32 in the bolt tail 24. Dog 28 then seats in the left lower notch 38 of the dog tail and causes the bolt 10 to be projected one step.

A second revolution of the key is effective in the same manner to cause the bolt to project a second step.

During the foregoing projection of the bolt, push-pull rod 40 causes disc 14 to rotate (clockwise) about axis 44, thereby projecting the rods 16*b*, 16*c* and 16*d*, first one step and then the second step, into their respective recesses in the door frame; thus, when bolt 10 has been projected two steps into its recess 6a the three rods have also been projected two steps into their respective recesses in sides 6*b*, 6*c* and 6*d* of the door frame. The door is thus securely locked on all four of its sides within the door frame, making it difficult for someone to force an entry without using the proper key.

One of the limitations in the locking device illustrated in FIG. 2 is that it is possible for one attempting an unauthorized entry to apply sufficient force to bolt 10 so as to break catch 34 in order to withdraw the bolt from the door frame. If this is successful, the rods 16*b*, 16*c* and 16*d* would not be securely held in their projected positions, and could be retracted by applying relatively little force to them since there would be nothing firmly holding disc 14 against rotation in the withdrawing direction.

The embodiment of the invention illustrated in FIG. 3 avoids this drawback. In the FIG. 3 embodiment, the coupling between dog 28 and the projectable rods 16*b*, 16*c*, 16*d*, upon the insertion and rotation of the proper key, is not effected by means of the bolt tail (24), but rather is effected by a separate toothed wheel 50 rotatably mounted about an axis 52 which is parallel to the keyhole axis, as well as the disc axis. In FIG. 3, the rotatable disc shown at 54 and rotatable about axis 56, is formed with a plurality of teeth 58 having recesses or notches 59 between them.

The embodiment of FIG. 3 further includes a plate 60 pivotable about a pin 62, the plate carrying a catch 64 seatable within a notch 59 formed in the rotatable disc 54. Plate 60 is biassed by a spring 66 to seat its catch 64 within a notch 59. When dog 28 engages edge 68 of plate 60 upon rotation of the dog clockwise in FIG. 3 to project the lock bolt, it first pivots plate 60 counter-clockwise about pin 62 to unseat catch 64 from notch 59, before the dog engages a tooth of wheel 50 to rotate the latter wheel and the rotatable disc 54.

It will be appreciated that the embodiment of FIG. 3 also includes the bolt 10, FIG. 2 movable by dog 28 of the cylinder 30, and the catch 34 for locking the bolt as described above with reference to FIG. 2. However, in the embodiment of FIG. 3, should one attempt a forced entry by applying sufficient force to bolt 10 to break its catch 34 (FIG. 2), this would not release disc 54 to rotate, as in the FIG. 2 embodiment, since disc 54 in FIG. 3 is firmly retained in position by catch 64 seated within notch 59. Accordingly, even if bolt 10 is forced open, this would not affect the rods 16*b*, 16*c* and 16*d* which would be securely held in position by catch 64.

FIGS. 4 and 5 illustrate a further variation, applicable to either embodiment of FIGS. 2 or 3, to prevent the possibility of sufficient force being applied to one of the rods 16*b*, 16*c*, 16*d* itself to break the disc catch 64 and to release the disc 54.

According to the embodiment of FIGS. 4 and 5, each of the rods 16*b*, 16*c*, 16*d* is pivotably mounted to the rotary disc, shown at 70 in FIGS. 4 and 5, by means of a curved link 72 pivotable at one end to the disc 70, and connected at the other end to the respective rod. The locking device further includes a plate 74 formed with three radial slots 76 aligned with the axis of rotation 78 of disc 70. A guiding pin 80 is carried by each rod 16*b*, 16*c*, and 16*d*, at the end thereof attached to its respective link 72, and passes through one of the slots 76 in plate 74.

The variation of FIGS. 4 and 5 operates as follows: When rotatable disc 70 is in the lock-releasing position, the guide pins 80 within slots 76 of plate 74 are disposed at the inner of the slots, as shown by the broken lines in FIG. 4. The rods 16*b*, 16*c*, 16*d* would thus be in their retracted positions. Now, as the disc 70 is rotated (counter-clockwise) in FIG. 4) to project the eccentrically-mounted rods 16*b*, 16*c* and 16*d*, by either of the mechanisms of FIGS. 2 or 3, slots 76 within plate 74 constrain pins 80 to move in a radial direction outwardly of the slots until the pins are aligned with the pivotable pins 73, at the other end of the links 72, and with the axis of rotation 78 of the rotatable disc 70. This is the position illustrated in full lines in FIG. 4.

Thus, if an attempt is made to force one of the rods 6*b*, 6*c* or 6*d*, to withdraw from its respective recess in the door frame, the force is applied along a line passing through the axis of rotation 78 of disc 70, and therefore will not apply a turning moment to the disc. Moreover, this force will be resisted by the counter-force applied by the opposed rod or by the lock bolt in the case of rod 16*d*), this counter-force also passing through the axis of rotation 78 of disc 70. Accordingly, it will be extremely difficult, if possible at all, to force the door open in this manner.

While the invention has been described with respect to several preferred embodiments, it will be appreciated that many other variations, modifications and applications can be made.

What is claimed is:

1. A key-operated door locking device including a lock casing mountable adjacent to one side of a door and having a keyhole for the insertion of a key; a cylinder within the casing and rotatable by the proper key when inserted into the keyhole and rotated therein; a dog carried by the cylinder and rotatable therewith; a bolt engageable by the dog and adapted to be projected and withdrawn with respect to the casing into and out of a recess in the door frame at said one side of the door; a rotatable member rotatably mounted on an axis substantially parallel to the axis of the keyhole; at least two rods each pivotably mounted at one end to a different eccentric point on the rotatable member and extending to the upper and lower edges of the door so as to be projected into further recesses in the door frame upon the rotation of the rotatable member in one direction, and to be withdrawn therefrom upon the rotation of the rotatable member in the opposite direction; a coupling between the cylinder dog and the rotatable member effective, upon the rotation of the dog by the proper key to cause the bolt to be projected into or withdrawn from its respective recess, also to cause the rotatable member to rotate and to project or withdraw the rods from their respective recesses; and a spring-biassed catch; said bolt including a tail having notches formed along one edge cooperable with the cylinder dog for projecting and withdrawing the bolt and for rotating the rotatable member to project and withdraw the rods, and further notches along another edge cooperable with said spring-biassed catch for securing the bolt and the rods in their projected or withdrawn positions.

2. A device as defined in claim 1, wherein said coupling includes a push-pull rod connected between the tail of the bolt and said rotatable member.

3. A device as defined in claim 1, wherein said rotatable member includes a catch which is released by the rotation of the dog before the dog rotates same to project or withdraw the rods.

4. A device as defined in claim 1, wherein said coupling includes a toothed wheel rotatably mounted on an axis parallel to the rotatable member and keyhole axes and rotatable by the dog for rotating the rotatable member.

5. A device as defined in claim 4, wherein the teeth of said toothed wheel engage recesses in the rotatable member for rotating same, the locking device further including a spring-biassed pivotable plate having a catch seatable in a recess of the rotatable member for securing same and the rods in their projected or withdrawn positions, the dog of the cylinder being effective, upon its rotation by the proper key, to first engage said pivotable plate to release the catch before engaging the toothed-wheel to rotate same and the rotatable member.

6. A device as defined in claim 1, wherein each rod is pivotably mounted at one end to the rotatable member by means of a link pivotable at one end to the rotatable member and connected at the other end to the respective rod.

7. A device as defined in claim 6, further including a plate formed with a pair of slots aligned with each other and with the axis of rotation of the rotatable member, said rods each including a guide element received in one of said slots and guiding the movement of the rod such that in the projected position of the rod, it is aligned with the pivotable end of its respective link and with the axis of rotation of the rotatable member.

8. A door including a locking device as defined in claim 1, the lock casing being mounted adjacent to one side of the door with the lock bolt projectable and withdrawable with respect to said side, the rotatable member including three rods projectable and withdrawable with respect to the remaining three sides of the door.

9. A key-operated door locking device including a lock casing mountable within a door and having a keyhole for the insertion of a key; a cylinder within the casing and rotatable by the proper key when inserted into the keyhole and rotated therein; a rotatable member rotatably mounted on an axis substantially parallel to the axis of the keyhole, said rotatable member including a recess; at least two rods each pivotably connected at one end to a different eccentric point on the rotatable member and extending to the upper and lower edges of the door so as to be projected into further recesses in the door frame upon the rotation of the rotatable member in one direction, and to be withdrawn therefrom upon the rotation of the rotatable member in the opposite direction; a coupling between the cylinder and the rotatable member effective, upon the rotation of the cylinder by the proper key, to cause the rotatable member to rotate and to project or withdraw the rods from their respective recesses; a pivotable plate including a catch; a spring for biassing said pivotable plate to seat its catch into said recess of the rotatable member; and a member carried by said cylinder for pivoting the pivotable plate to unseat its catch from said recess in the rotatable member before the cylinder rotates same to project or withdraw the rods.

10. A device as defined in claim 9, wherein said coupling includes a toothed wheel rotatably mounted on an axis parallel to the rotatable member and keyhole axes and rotatable by the cylinder for rotating the rotatable member; said rotatable member including a plurality of recesses engaged by the teeth of said toothed wheel for rotating the rotatable member upon rotation of the cylinder.

* * * * *